US008869968B2

(12) United States Patent
Cieslikowski

(10) Patent No.: US 8,869,968 B2
(45) Date of Patent: Oct. 28, 2014

(54) METHOD OF MASS FLOW CONTROL AND DEVICES FOR MASS FLOW CONTROL

(75) Inventor: Bartosz Cieslikowski, Przysucha (PL)

(73) Assignee: International Tobacco Machinery Poland SP. Z O.O., Radom (PL)

( * ) Notice: Subject to any disclaimer, the term of this patent is extended or adjusted under 35 U.S.C. 154(b) by 174 days.

(21) Appl. No.: 13/576,290

(22) PCT Filed: Feb. 8, 2011

(86) PCT No.: PCT/PL2011/000012

§ 371 (c)(1),
(2), (4) Date: Jul. 31, 2012

(87) PCT Pub. No.: WO2011/099880

PCT Pub. Date: Aug. 18, 2011

(65) Prior Publication Data

US 2012/0321428 A1 Dec. 20, 2012

(30) Foreign Application Priority Data

Feb. 10, 2010 (PL) ..... 390413

(51) Int. Cl.
*B65G 1/00* (2006.01)
*A24C 5/35* (2006.01)

(52) U.S. Cl.
CPC ..... *A24C 5/35* (2013.01)
USPC ..... 198/347.1; 198/347.2; 198/457.05

(58) Field of Classification Search
USPC ..... 198/347.1, 347.2, 530, 532, 457.05, 198/459.6
See application file for complete search history.

(56) References Cited

U.S. PATENT DOCUMENTS 3,305,128 A * 2/1967 Dearsley ..... 198/347.2
4,222,477 A * 9/1980 Molins et al. ..... 198/347.3
4,553,660 A 11/1985 Bennett et al.
4,744,453 A 5/1988 Krause et al.

(Continued)

FOREIGN PATENT DOCUMENTS

EP 1795076 A1 6/2007
EP 1989945 A1 11/2008

(Continued)

OTHER PUBLICATIONS

International Search Report of PCT/PL2011/000012, mailing date of Aug. 1, 2011.

(Continued)

*Primary Examiner* — James R Bidwell
(74) *Attorney, Agent, or Firm* — Westerman, Hattori, Daniels & Adrian, LLP

(57) ABSTRACT

The method of control consists in altering the flow path by means of swing and/or slide shiftable movable elements, constituting a fragment of the opposite side walls of an angularly positioned channel, which after shifting stop the flow of rod-shaped articles with the possibility of restoring the flow after shifting the movable elements to previous position. The device is situated in the channel, the first side wall of which is provided with a first movable element, and a fragment of the opposite second side wall forms a second movable element, with the first movable element being mounted on a pivot together with a perpendicular plate, on which also the second movable element by means of an actuator is mounted. The second element has the shape of a cylinder sector. Below the movable elements, and above the horizontal conveyor, is situated a shutoff element.

11 Claims, 7 Drawing Sheets

(56) References Cited

U.S. PATENT DOCUMENTS

| | | | | |
|---|---|---|---|---|
| 4,787,497 | A * | 11/1988 | King et al. | 198/347.2 |
| 4,986,408 | A | 1/1991 | Carter et al. | |
| 5,217,101 | A | 6/1993 | Raschka | |
| 5,529,164 | A | 6/1996 | Meinke et al. | |
| 6,390,273 | B1 * | 5/2002 | Muller | 198/347.1 |
| 7,044,286 | B2 * | 5/2006 | Sikora et al. | 198/457.05 |
| 7,571,798 | B2 * | 8/2009 | Spatafora | 198/347.2 |
| 2004/0231961 | A1 | 11/2004 | Sikora et al. | |
| 2007/0137662 | A1 | 6/2007 | Borderi et al. | |
| 2008/0286078 | A1 | 11/2008 | Kroessmann | |
| 2009/0025737 | A1 | 1/2009 | Leifheit | |

FOREIGN PATENT DOCUMENTS

| | | | |
|---|---|---|---|
| EP | 2022348 | A2 | 2/2009 |
| GB | 2179614 | A | 3/1987 |
| WO | 02/096227 | A2 | 12/2002 |

OTHER PUBLICATIONS

Written Opinion of PCT/PL2011/000012, mailing date of Aug. 1, 2011.

* cited by examiner

METHOD OF MASS FLOW CONTROL AND DEVICES FOR MASS FLOW CONTROL

BACKGROUND OF THE INVENTION

Subject-matter of the invention is a method of controlling mass flow in the form of multi layer stream of rod-shaped articles, particularly tobacco industry products, and a device for controlling the said flow.

In production lines manufacturing rod shaped tobacco articles, like cigarettes, filters or cigarettes with filters already stuck on, in the course of the production process the said products cover a considerable distance after leaving the manufacturing machine before they are placed in packets in the packing machine or in the stores. The flow usually takes place in a multi layer ordered stream, which eliminates deformation or destruction. There is a need for handling the stream of products in order to convey it to or from different devices used in the production line. For this purpose, on the path of horizontal conveyor carrying the articles, near-perpendicular channels which connect one horizontal conveyor with another horizontal conveyor or receiver are made. Rod-shaped articles fill fully vertical channels and principally horizontal conveyors, which is a condition determining the state of their order. The flow on a horizontal path is usually forced by a conveyor, while the flow in angularly situated channels usually takes place by gravity. The said flow handling consists many times in cutting off the channel in which the articles flow or in directing the stream of articles to another receiving device, with the necessary condition being that rod-shaped articles are as little damaged as possible when controlling the flow. Devices for stopping the flow of a stream and/or changing its direction are known in the state of the art. For instance, from the U.S. Pat. No. 5,217,101 a device is known for connecting mass flows of rod-shaped articles in the tobacco industry in which a plate or a shaped gate swivel-mounted on the axis situated near the connection point of horizontal conveyor with angular channel is used, with the plate or shaped gate being opened when a too small flow of the stream is detected or a need for connecting the streams arises. The shaped gate may form simultaneously an interim mini-store stockpiling the overflow of rod-shaped articles. Another device for transporting rod-shaped articles is known from the U.S. Pat. No. 5,529,164. In this construction, a slidable plate provided with a flexible tape which in case of need is angularly inserted in accordance with the direction of stream flow in the upper part of the vertical channel thus shutting off its inlet is used, with the flexible tape becoming a part of the bottom wall of horizontal conveyor. A temporary overflow of articles is absorbed by a generally known pocket formed by two self-aligning arms arranged in the upper wall of horizontal conveyor in the channel axis, with arm ends being connected by a membrane. On the other hand, in the description of the U.S. Pat. No. 4,986,408 concerning a device for handling rod-shaped articles, an attempt to use a slidable plate arranged parallel to the path of horizontal stream of rod-shaped articles that separates this stream from the vertical channel was made. The invention presents different technical solutions for the plate itself as well as for the means of its activation. A drawback of this solution is the possibility of damaging rod-shaped articles during horizontal inserting of the plate into the area of the channel filled with these articles. A similar principle of cutting off the flow by a tape-type element inserted between rod-shaped articles above the inlet of vertical channel was shown in the U.S. Pat. No. 4,553,660. A solution nearest to the subject-matter of the applied invention was presented in the description of the U.S. Pat. No. 7,044,286 concerning the separation of streams of multi layer flows of rod-shaped articles. According to the described method, rod-shaped articles are removed, for the purpose of separation, from the border area of horizontal conveyor or angularly situated channel, which becomes a passive stream, to the area of horizontal channel or conveyor, which becomes an active stream, and the amount of removed articles is equal to the volume of a corresponding part of a cylinder with a radius corresponding to the width of horizontal conveyor and/or the width of the channel, with cylinder walls parallel to its axis separating non-parallel streams from each other. Said articles may be also closed in a niche with the shape of horizontal conveyor or channel made inside the rotating cylinder, across the axis of rotation, with the rotation axis of the cylinder being in the symmetry plane of the niche, and besides the rotation axis of the cylinder being in the symmetry plane of the horizontal conveyor and/or channel, and the articles being shut by a rotation of the cylinder. Presented valve device for separating streams according to said invention consists of a valve in form of a cylinder or its sector situated in the crossing point of horizontal conveyor and channel, with the rotation axis of the valve being the axis of the cylinder and overlapping the intersection edge of upper plane of the wall of horizontal conveyor with the plane of side wall of the channel or the intersection edge of the plane of the bottom wall of horizontal conveyor with the plane of side wall of the channel, or the rotation axis of the valve being in symmetry plane of the channel and/or horizontal conveyor in a distance from the intersection edge of side wall of the channel with the wall of horizontal conveyor equal to or a little greater than the cylinder radius, while inside the cylinder a through niche with the shape of the channel and/or horizontal conveyor is made, with the rotation axis of the valve being in symmetry plane of the niche. The above solution partly eliminates the degradation of the outer layer of articles in passive stream and facilitates the flow of multi layer stream with any speed, with the removal of articles to active stream preventing pressure buildup in the stream, and the removal of articles from the border area not causing a disturbance of their ordered reciprocal arrangement. Removed articles are indeed replaced by the cylinder wall on which the stream flows, however, when inserting the sharp edge of cylinder valve in the stream of articles, which does not have a possibility of shock absorption, a degradation of a part of articles being in direct contact with said edge may occur.

BRIEF SUMMARY OF THE INVENTION

According to the invention, a significant feature of the method of controlling mass flow in the form of a multi layer stream of rod-shaped articles filling a channel positioned angularly in relation to horizontal plane, in which the flow of rod-shaped articles takes place by gravity or is forced, is an alteration of mass flow path by means of swing and/or slide shiftable movable elements being a fragment of opposite side walls of the angularly positioned channel, with each wall of the channel being provided with at least one movable element. Said movable elements are shifted independently on one another, with the possibility of shifting them while keeping parallelism or non-parallel. After shifting, movable elements may stop the mass flow in the angularly positioned channel or direct the flow to another receiving device or simultaneously to multiple receiving devices, with the possibility of restoring the previous flow after shifting movable elements to previous position. Such method allows reducing the degradation of the outer layer of rod-shaped articles due to absorption of the pressure of movable element of one side wall by pushing aside the movable element of the opposite wall. Moreover, mass flow may be stopped or directed to another or simultaneously multiple receivers.

The object of the invention is also the construction of the device for controlling mass flow in the form of multi layer stream of rod-shaped articles filling a channel positioned angularly relative to horizontal plane, where the flow of rod-shaped articles takes place by gravity or is forced, with said channel having side walls where the first wall is provided with the first movable element, and on the opposite second side wall is arranged the second movable element being a fragment of the second side wall of the channel. The lower part of the first side wall may be formed by the first movable element swivel-mounted on the pivot parallel to side wall planes and arranged just below the upper part of the first side wall, where on the pivot is swivel-mounted, permanently and together with the first movable element, a plate perpendicular to side walls of the channel, and to the plate is attached the second movable element constituting a fragment of the opposite second side wall and giving the second element the reciprocating motion by means of an actuator mounted on the plate. Preferably, the second movable element has the shape of a cylinder with an inside cut-out corresponding to the width of narrowed part of the second side wall of the channel. The end of the first side wall below the first movable element forms a shutoff element situated outside of the first side wall, with said shutoff element preferably having the shape of a cylinder jacket sector with a radius corresponding to the length of the first movable element. In the construction variation of a device according to the invention, a lower part of the first side wall is formed by the first movable element slidably mounted in the direction outwards to the first side wall and moving inside a store formed outside of the lower part of the channel, and the second movable element, constituting a fragment of opposite second side wall, is mounted by means of an actuator giving the second element a reciprocating motion, to a plate swivel-mounted on a pivot parallel to side wall planes, with the first movable element being coupled with the plate with the aid of a Scotch yoke mechanism. In another construction variation of a device according to the invention, the lower part of the first side wall is formed by the first movable element consisting of two, upper and lower, plates swivel-mounted with its ends appropriately on pivots parallel to side wall planes, with the upper plate being mounted on a pivot arranged at the end of the immovable first part of side wall, and the lower plate being mounted on a pivot arranged at the end of the channel, while the second movable element has the shape of a triangular prism whose long side is parallel to the second side wall and which has an inside cut-out corresponding to the width of narrowed part of the second side wall of the channel and makes reciprocating motion in the direction inwards the channel, oriented with its vertex, opposite to the long side, to the side of the point of contact of upper plate and lower plate of the first movable element. In another construction variation of a device according to the invention, the lower part of the first side wall is formed by the first movable element swivel-mounted on a pivot parallel to side wall planes and arranged just below the upper part of the first side wall, and the lower part of the second side wall is formed by the second movable element swivel-mounted on a pivot parallel to side wall planes and arranged just below the upper part of the second side wall, with a disposal path situated below the movable elements and arranged diagonally relative to the channel. Below the disposal path, a container for defective rod-shaped articles may be arranged, while movable elements may move non-parallel or parallel to each other. In another construction variation of a device according to the invention, a lower part of the first side wall is formed by the first movable element swivel-mounted on a pivot parallel to side wall planes and arranged just below the upper part of the first side wall, and a lower part of the second side wall is formed by the second movable element, swivel-mounted on a pivot parallel to side wall planes and arranged just below the upper part of the second side wall, with the first side wall below the first movable element being provided with a shutoff element situated outside the first side wall which may have the shape of a cylinder jacket sector. Preferably, the movable elements move parallel. An advantage of all construction variations according to the invention is the possibility of free control of the mass flow of rod-shaped articles in a channel situated angularly relative to horizontal conveyor, including directing the stream of articles to different receivers or temporary flow stopping, with rod-shaped articles in principle not being degraded during the operation of movable elements being at the same time the side walls of the channel.

BRIEF DESCRIPTION OF THE DRAWINGS

The object of the invention was shown in embodiments in schematic drawing in which.

DETAIL DESCRIPTION OF THE INVENTION

Embodiment I

Figure 1:
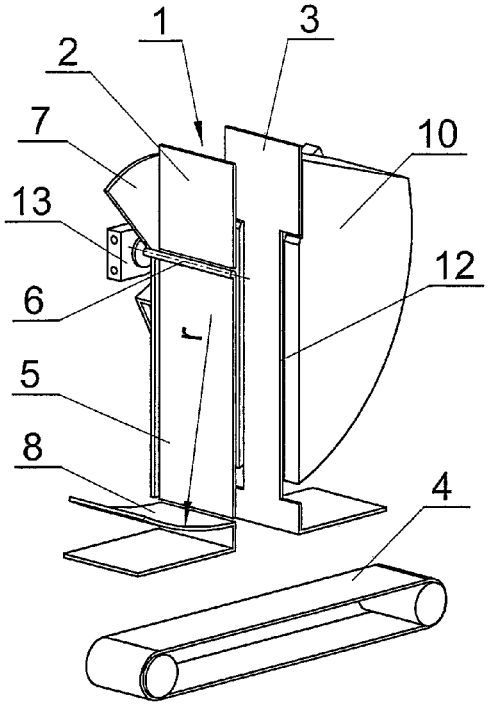
FIG. 1 shows in a perspective view a device for controlling mass flow of rod-shaped articles using movable elements forming side walls of a channel in the shape of an appropriately swinging plate and a cylinder sector with open flow, FIG. 2—device of FIG. 1 in a perspective rear view, FIG. 3—device of FIG. 1 in front view in a position of flow shut-off, FIG. 4—device of FIG. 3 in an intermediate return position of the movable element in the shape of a cylinder sector, FIG. 5—device of FIG. 3 in a subsequent intermediate return position of movable element in the shape of a cylinder sector with open flow, FIG. 6—a perspective view of the embodiment of the device of FIG. 1 using the first movable element in the shape of a slidable plate, FIG. 7—device of FIG. 6 in rear view, FIG. 8—device of FIG. 6 in front view with shut-off flow, FIG. 9—device of FIG. 8 with open flow and shifted plate of movable element, and retracted movable element in the shape of a cylinder sector in an intermediate position, FIG. 10—device of FIG. 8 with open flow and movable element in the shape of a cylinder sector retracted to another intermediate position, FIG. 11—perspective view of an embodiment of the device using movable elements in the shape of appropriately two rotatable plates and slidable triangular prism with open flow, FIG. 12—device of FIG. 1 in front view with shut-off flow, FIG. 13—perspective view of a variation of the device using movable elements in the shape of swinging plates, FIG. 14—device of FIG. 13 in side view when the mass flow is directed to slantwise path, FIG. 15—device of FIG. 14 where below the disposal path a container is arranged, FIG. 16—perspective view of the device using movable elements in the shape of swinging plates and an outside shut-off element, with open flow, and FIG. 17—device of FIG. 16 with the mass flow shut off.
Figure 2:
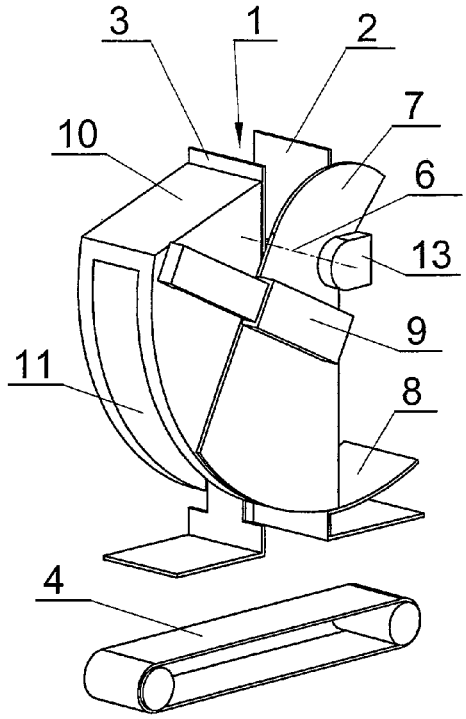
Figure 3:
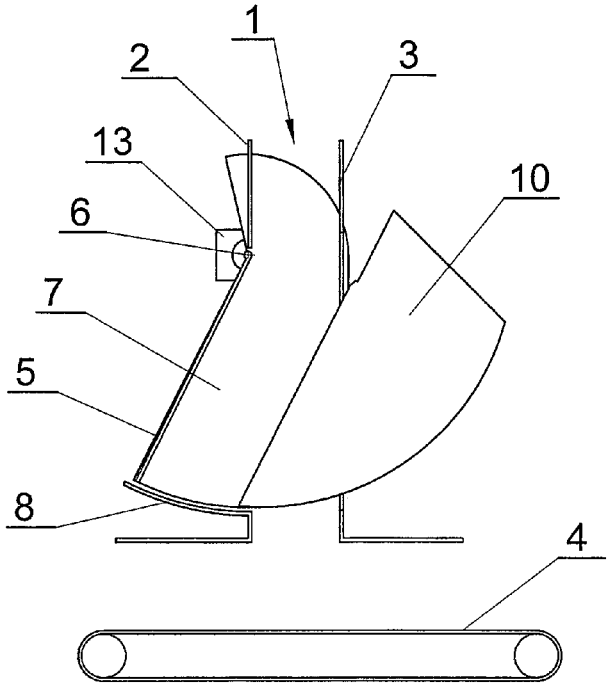
Figure 4:
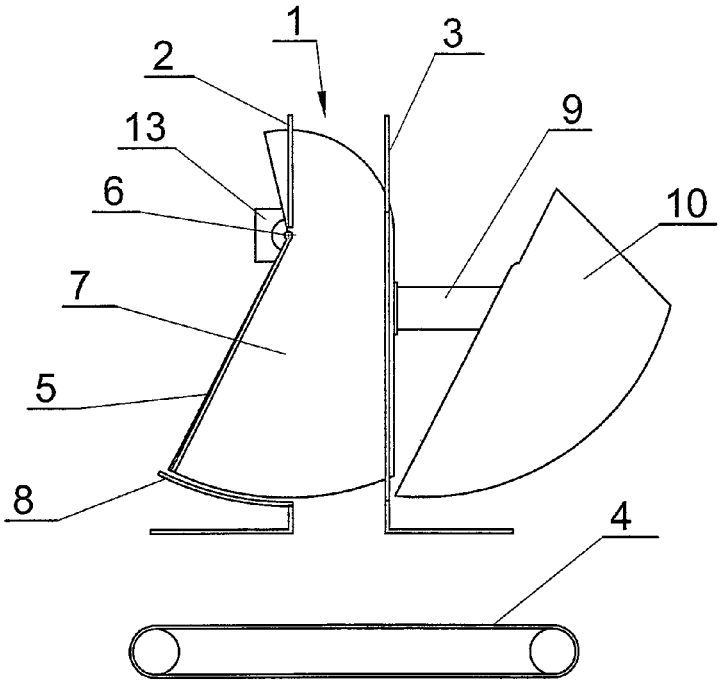
Figure 5:
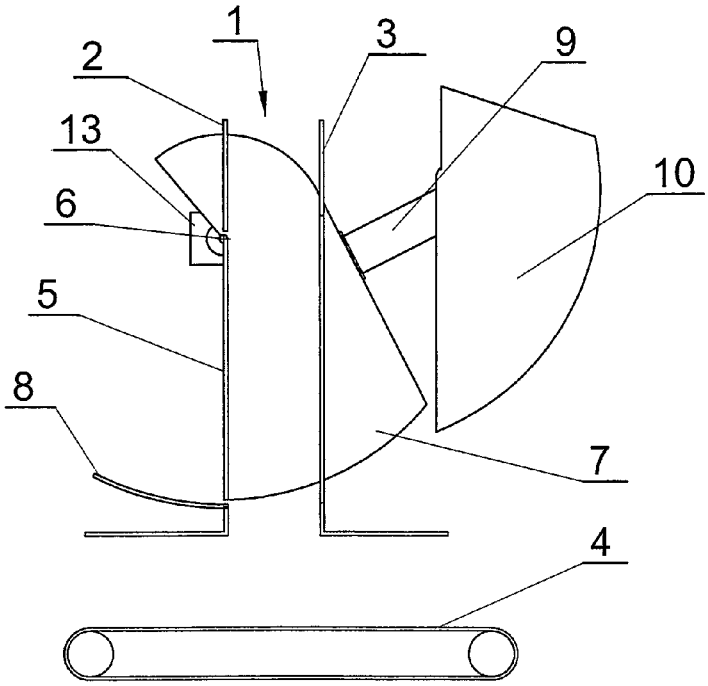
Figure 6:
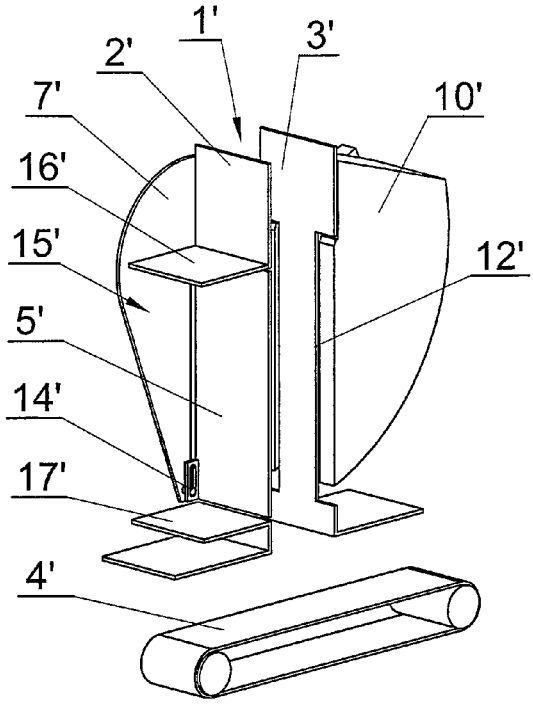
Figure 7:
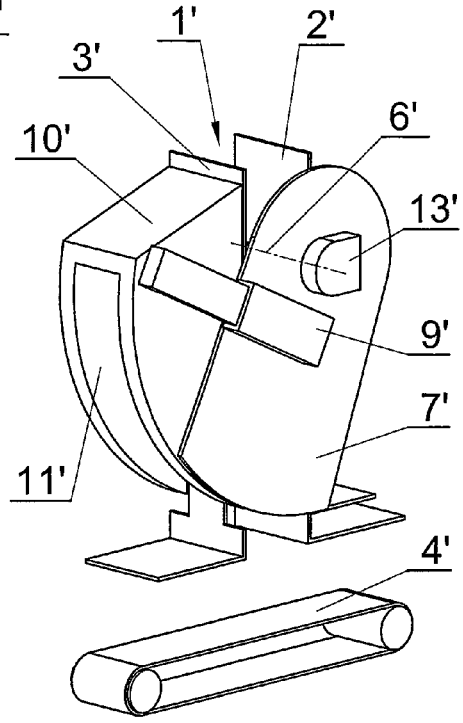
Figure 8:
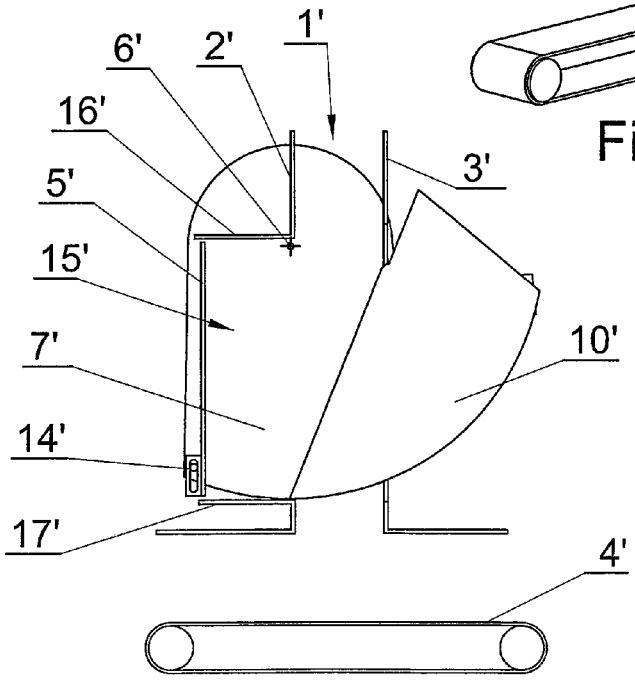
Figure 9:
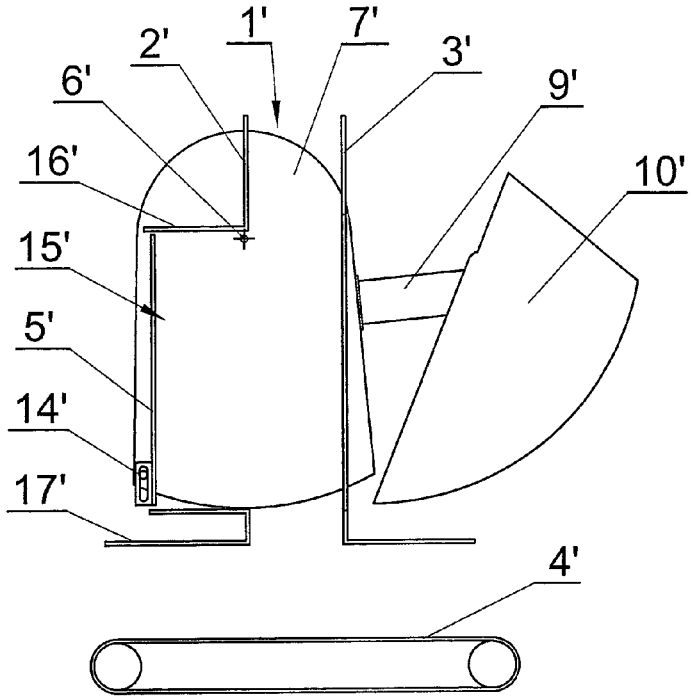
Figure 10:
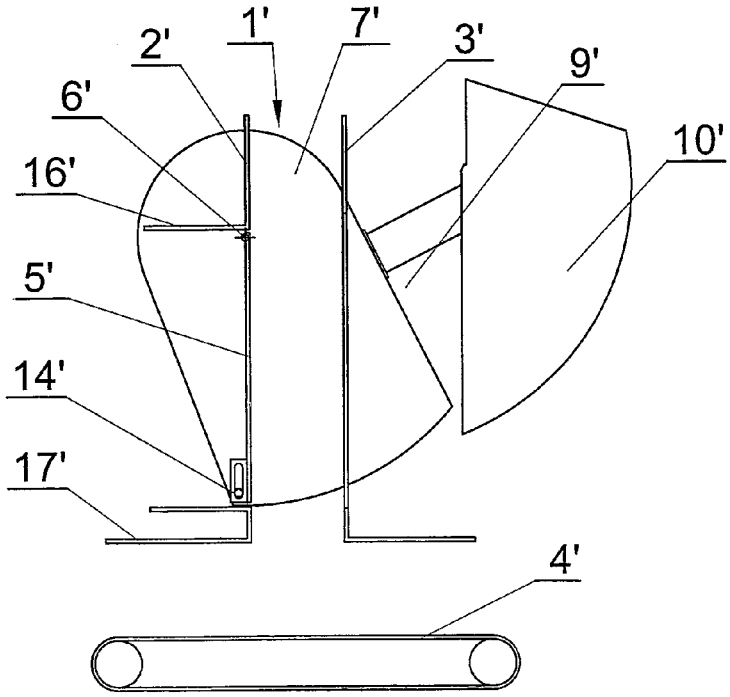

The device shown in FIG. 1 to FIG. 5 for controlling the mass flow of rod-shaped articles flowing in a vertically positioned channel 1, having a first side wall 2 and a second side wall 3 in the direction of a horizontal conveyor 4, contains a first movable element 5 forming the lower part of the first side wall 2, swivel-mounted on a pivot 6 parallel to the planes of side walls 2 and 3 and arranged just below the first side wall 2 in its plane. Swivel-mounted on the pivot 6 is a plate 7 perpendicular to side walls 2 and 3, with the first movable element 5 making a rotation together with the plate 7. The end of the first side wall 2 below the first movable element 5 is provided with a shutoff element 8 situated outside the first side wall 2 which has the shape of a cylinder jacket sector of a radius r corresponding to the length of the first movable element 5. By means of an actuator 9, on the plate 7 is mounted a second movable element 10 forming a fragment of the second side wall 3, with the actuator 9 giving the second element 10 a reciprocating motion. The second movable element 10 has the shape of a cylinder with an inside cut-out 11 corresponding to the width of narrowed part 12 of the second side wall 3. A drive 13 of the pivot 6 and the actuator 9 are situated on the rear side of the plate 7.

In case it is necessary to stop the mass flow of rod-shaped articles flowing in the channel 1, of which a part of the first side wall 2 constitutes the first movable element 5, and a part of the second side wall 3 constitutes the second movable element 10 together with the narrowed part 12, the plate 7 makes a rotation together with the elements 5 and 10 around the pivot 6 until the end of the second movable element 10 is situated at the edge of the shutoff element 8, and the first movable element 5 is situated at the end of the shutoff element 8, with the cylinder chord plane of the second movable element 10 keeping, during rotation, parallelism to the plane of the first movable element 5. That way the flow is shut off, and the rod-shaped articles are placed in a niche formed by the movable elements 5 and 10 and the shutoff element 8. When reopening the flow in the channel 1, in order to avoid the degradation of rod-shaped articles, at first, by means of the actuator 9 the second movable element 10 is retracted, with the narrowed part 12 forming then the second wall 3 of the channel 1, and then the plate 7 making the return rotation together with the movable elements 5 and 10 until the plane of the first movable element 5 overlaps the plane of the first side wall 2, after which the actuator 9 brings the second movable element 10 to initial position so that the cylinder chord plane overlaps the plane of narrow part 12 of the second side wall 3 of the channel 1.

Embodiment II

The device shown in FIG. 6 to FIG. 10 for controlling the mass flow of rod-shaped articles is similar to the device described in embodiment I, except that the first movable element 5' constitutes a plate coupled with a pivot 6' by means of a Scotch yoke mechanism 14', with the movable element 5' making reciprocating motion inside a store 15' formed from the outward-bent end 16' of the upper part of the first side wall 2' and the horizontal wall 17' situated below the first movable element 5'. All other elements, structurally and functionally identical as in embodiment I, have been denoted in the drawing with the symbol '.

Embodiment III

Figure 11:
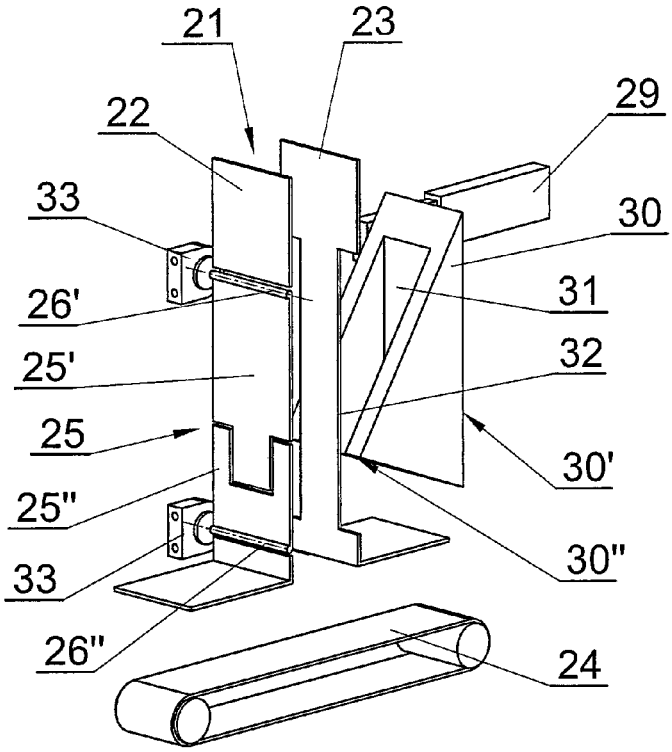
Figure 12:
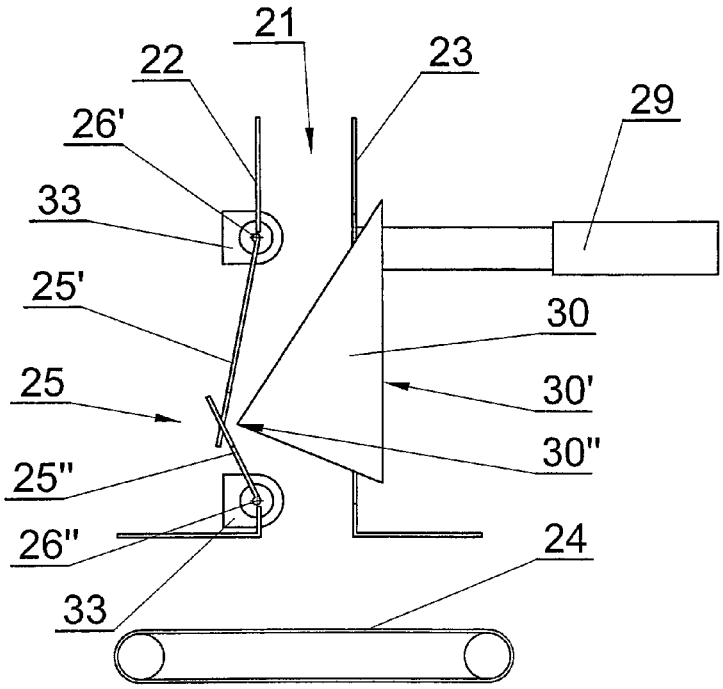

The device shown in FIG. 11 and FIG. 12 for controlling the mass flow in the channel 21, having a first side wall 22 and a second side wall 23, with rod-shaped articles flowing in the direction of a horizontal conveyor 24, contains a first movable element 25 forming the lower part of the first side wall 22, consisting of an upper plate 25' and a lower plate 25", with the upper plate 25' being swivel-mounted with its upper end on the pivot 26' parallel to the planes of side walls 22 and 23 and situated just below the first side wall 22 in its plane, and the lower plate 25" being mounted on the pivot 26" situated at the end of the channel 21. The device has an actuator 29 coupled with the second movable element 30 forming a fragment of the second side wall 23. The element 30 has the shape of triangular prism with a long side 30' parallel to the second side wall 23 and a vertex 30" opposite to the long side 30', directed to the point of contact of the upper plate 25' and the lower plate 25" of the first movable element 25. The second movable element 30 has an inside cut-out 31 corresponding to the width of narrowed part 32 of the second side wall 23.

In case it is necessary to stop the mass flow, the second movable element 30 driven by the actuator 29 enters with its vertex 30" the area of the channel 21 filled with rod-shaped articles, where, for the purpose of absorption of pressure of the element 30, the drives 33 push aside the upper plate 25' and the lower plate 25", forming an interim mini-store opposite the element 30. The element 30 does not have to shut the channel 21 completely in order to interrupt the flow because rod-shaped articles will be stopped due to increased pressure in the area of operation of the vertex 30". The retraction of the element 30 will result in restored flow, with the plates 25' and 25" being rotated simultaneously until they take a position in one plane with the first side wall 22.

Embodiment IV

Figure 13:
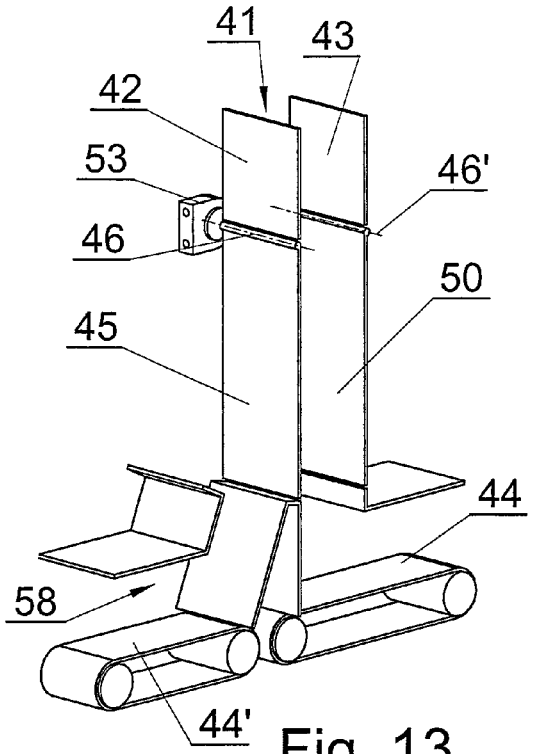
Figure 14:
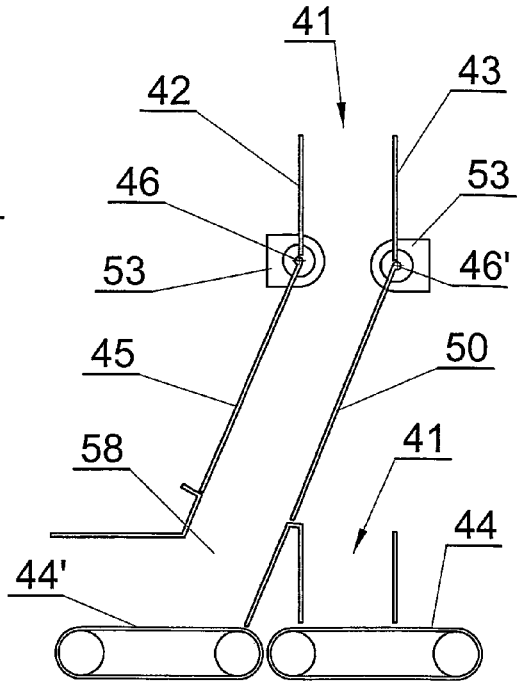
Figure 15:
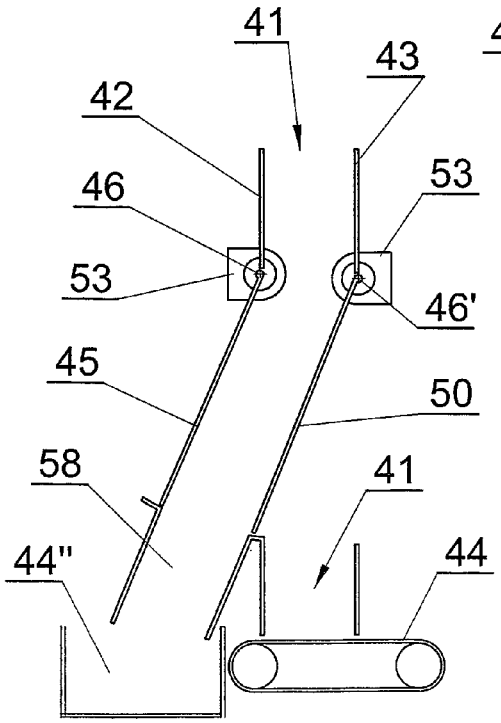

The device shown in FIG. 13 to FIG. 15 for controlling the mass flow in the channel 41 having a first side wall 42 and a second side wall 43, with rod-shaped articles flowing in the direction of horizontal conveyor 44, contains a first movable element 45, forming a part of the side wall 42, swivel-mounted on the pivot 46 parallel to the planes of side walls 42 and 43 situated just below the upper part of the first side wall 42 in its plane. Below the first movable element 45, outside the lower part of the first side wall 42 is a disposal path 58 situated slantwise relative to the channel 41, the outlet of which is situated above an additional horizontal conveyor 44'. Alternatively, instead of the conveyor 44' a container 44" for defective rod-shaped articles may be arranged (FIG. 15). Below the upper part of the second side wall 43 is situated, swivel-mounted on a pivot 46', the second movable element 50 forming a part of the second side wall 43, with the pivot 46 being parallel to the planes of side walls 42 and 43 and being situated just below the upper part of the second side wall 43 in its plane. The pivots 46 and 46' are coupled with the drives 53.

In case it is necessary to direct the flow to another receiver, the movable elements 45 and 50 move parallel by rotation around the pivots 46 and 46' forced by the drives 53 and direct rod-shaped articles above the throat of the disposal path 58 and further to the additional conveyor 44' or the container 44". Movable elements 45 and 50 may also move non-parallel, as a result of which the conveyors 44 and 44' may be simultaneously supplied with the mass flow.

Embodiment V

Figure 16:
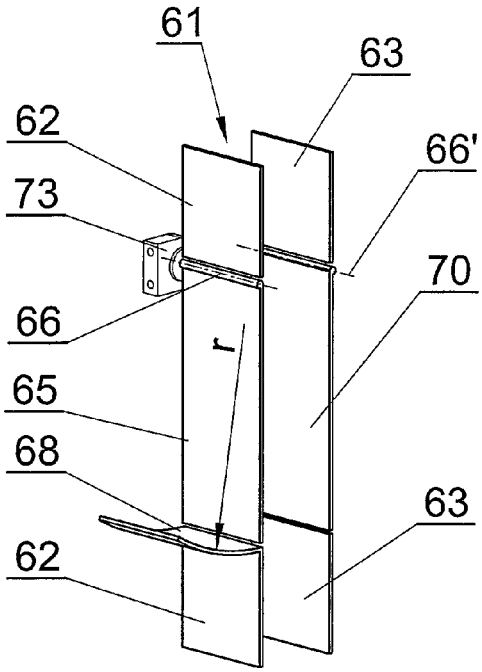
Figure 17:
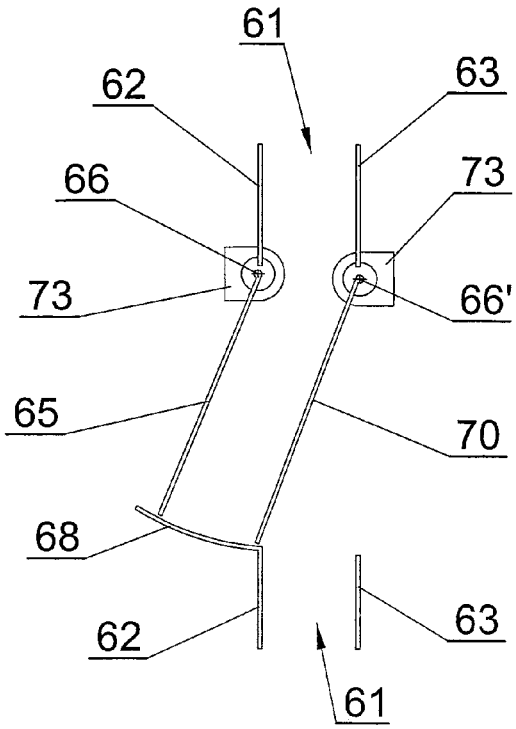

The device shown in FIG. 16 and FIG. 17 for controlling the mass flow in the channel 61 having a first side wall 62 and a second side wall 63, with rod-shaped articles flowing by gravity down the channel 61, contains a first movable element 65, forming a part of the side wall 62, swivel-mounted on a pivot 66 parallel to the planes of side walls 62 and 63 and situated just below the upper part of the first side wall 62 in its plane. Below the first movable element 65, a shutoff element 68 having the shape of a cylinder jacket sector is situated. Below the upper part of the second side wall 63 is, swivel-mounted on a pivot 66', a second movable element 70 forming a part of the second side wall 63, with the pivot 66' being parallel to the planes of side walls 62 and 63 and being situated just below the upper part of the second side wall 63 in its plane. The pivots 66 and 66' are coupled with the drives 73.

In case it is necessary to shut off the flow, the movable elements 65 and 70 move parallel by rotation around the pivots 66 and 66' forced by the drives 73 until the end of the first movable element 65 is situated at the end of the shutoff element 68, and the end of the second movable element 70 is situated at the edge of the shutoff element 68. The retraction of movable elements 65 and 70 to the initial position results in restored mass flow in the channel 61.

The invention claimed is:

1. A method of controlling mass flow in a form of a multi layer stream of rod-shaped articles filling a channel positioned angularly relative to horizontal plane in which the mass flow of rod-shaped articles takes place by gravity or is forced, comprising altering a path of mass flow by means of swing and/or slide shiftable movable elements being a fragment of opposite side walls of the angularly positioned channel, with each wall of the channel being provided with at least one movable element;

wherein the movable elements after shifting stop the mass flow or direct the path of mass flow to at least another receiving device and wherein the movable elements are shifted independently of each other.

2. The method as in claim 1, wherein the movable elements are shifted while keeping parallel relative to each other.

3. The method as in claim 1, wherein the movable elements are shifted nonparallel relative to each other.

4. The method as in claim 1, wherein the movable elements after shifting stops the mass, flow in the angularly positioned channel, with a possibility of restoring the mass flow by shifting the movable elements to previous position.

5. The method as in claim 1, wherein, the movable elements after shifting direct the mass flow to another receiving device, with a possibility of restoring the mass flow by shifting the movable elements to previous position.

6. The method as in claim 1, wherein, the movable elements after shifting direct the mass flow to multiple receiving devices, with a possibility of restoring the mass flow by shifting the movable elements to previous position.

7. A device for controlling mass flow in a form of a multi layer stream of rod-shaped articles comprising:

a channel positioned angularly relative to horizontal plane, wherein the flow of rod-shaped articles takes place by gravity or is forced, said channel having a first side wall and a second side wall, a lower part of the first side wall is provided with a first movable element, the second side wall having a second movable element constituting a fragment of the second side wall independently movable relative to said first movable element.

8. A device for controlling mass flow in a form of a multi layer stream of rod-shaped articles comprising:

a channel positioned angularly relative to horizontal plane, wherein the flow of rod-shaped articles takes place by gravity or is forced, said channel having a first side wall and a second side wall, a lower part of the first side wall is provided with a first movable element, and the second side wall is provided with a second movable element constituting a fragment of the second side wall the first movable element being swivel-mounted on a pivot parallel to the second side wall and situated just below an upper part of the first side wall, a plate swivel-mounted on said pivot, said plate perpendicular to the first side wall and the second side wall of the channel, where said plate rotates permanently and together with the first movable element, and wherein on the plate is mounted said second movable element, by means of an actuator mounted on the plate, giving the second element a reciprocating motion.

9. The device as in claim 8, wherein the second movable element has a shape of a cylinder sector with an inside cut-out corresponding to a width of a narrowed part of the second side wall of the channel.

10. The device as in claim 8, wherein an end of the first side wall below the first movable element forms a shutoff element situated outside the first side wall.

11. The device as in claim 10, wherein the shutoff element has a shape of a cylinder jacket sector with a radius (r) corresponding to a length of the first movable element.

* * * * *